US011028459B2

(12) United States Patent
Thevenet

(10) Patent No.: US 11,028,459 B2
(45) Date of Patent: Jun. 8, 2021

(54) METHOD FOR ORIENTING STEEL SHEET GRAINS, CORRESPONDING DEVICE, AND FACILITY IMPLEMENTING SAID METHOD OR DEVICE

(71) Applicant: FIVES STEIN, Maisons Alfort (FR)

(72) Inventor: Pascal Thevenet, Yerres (FR)

(73) Assignee: FIVES STEIN, Maisons Alfort (FR)

( * ) Notice: Subject to any disclaimer, the term of this patent is extended or adjusted under 35 U.S.C. 154(b) by 363 days.

(21) Appl. No.: 15/523,450

(22) PCT Filed: Oct. 28, 2015

(86) PCT No.: PCT/IB2015/058308

§ 371 (c)(1),
(2) Date: May 1, 2017

(87) PCT Pub. No.: WO2016/067214

PCT Pub. Date: May 6, 2016

(65) Prior Publication Data

US 2017/0314096 A1 Nov. 2, 2017

(30) Foreign Application Priority Data

Oct. 29, 2014 (FR) ..... 1460385

(51) Int. Cl.
*C21D 9/56* (2006.01)
*C21D 8/12* (2006.01)
(Continued)

(52) U.S. Cl.
CPC ..... *C21D 9/564* (2013.01); *C21D 8/125* (2013.01); *C21D 8/1238* (2013.01);
(Continued)

(58) Field of Classification Search
CPC ..... C21D 9/563; C21D 9/564
See application file for complete search history.

(56) References Cited

U.S. PATENT DOCUMENTS 2,083,275 A 6/1937 Romig
2,980,561 A * 4/1961 Ford ..... H01B 3/04 148/245

(Continued)

FOREIGN PATENT DOCUMENTS

FR 2176698 11/1973
GB 2001558 2/1979
JP S50139707 U * 11/1975 ..... C21D 1/26

OTHER PUBLICATIONS

Espacenet machine translation of JP S50-139707 (Year: 2020).*

(Continued)

*Primary Examiner* — Sheng H Davis
*Assistant Examiner* — Christopher D. Moody
(74) *Attorney, Agent, or Firm* — The Belles Group, P.C.

(57) ABSTRACT

The invention concerns a method for accentuating the orientation of the grains of a continuous steel sheet (1), in particular for producing electrical sheet steel, said method involving, during the movement of the steel sheet (1) in the longitudinal direction of same, a longitudinal stretching of the steel sheet (1) in a stretch region (1*d*) in which the steel sheet (1) moves at a temperature of between approximately 750° C. and approximately 900° C. The invention also concerns a device for implementing said method in which the stretching is carried out by two tensioning blocks (41, 42) comprising traction rollers arranged to move and guide the steel sheet (1). The invention further concerns a facility for producing electrical sheet steel comprising a line comprising a rolling mill and on which said method and said device are implemented downstream from the rolling mill.

21 Claims, 3 Drawing Sheets

(51) Int. Cl.
*F27B 9/28* (2006.01)
*F27B 17/00* (2006.01)

(52) U.S. Cl.
CPC ..... *C21D 8/1255* (2013.01); *C21D 8/1261* (2013.01); *C21D 9/56* (2013.01); *C21D 9/563* (2013.01); *F27B 9/28* (2013.01); *F27B 17/00* (2013.01); *C21D 2201/05* (2013.01)

(56) References Cited

U.S. PATENT DOCUMENTS 3,130,088 A 4/1964 Cook
3,421,925 A 1/1969 Hair et al.
RE30,851 E * 1/1982 Toda ..... B21B 31/10 148/505
RE30,933 E * 5/1982 Toda ..... B21B 31/10 266/111
4,358,093 A 11/1982 Shimoyama et al.
4,375,283 A * 3/1983 Shimoyama ..... C21D 9/56 266/102
4,482,397 A * 11/1984 Datta ..... C21D 8/125 148/111
4,571,274 A * 2/1986 Yanagishima ..... C21D 9/563 148/500
5,085,411 A * 2/1992 Tanaka ..... C21D 8/1294 148/110
5,143,561 A * 9/1992 Kitamura ..... C21D 8/1277 148/111
5,497,817 A * 3/1996 Ikegami ..... C21D 9/563 148/500
5,690,757 A * 11/1997 Ljungars ..... C21D 9/564 148/603
5,739,438 A * 4/1998 Sawada ..... C21D 9/564 73/862.391
6,273,975 B1 * 8/2001 Van Der Meulen ..... B21B 15/0007 148/508
6,432,222 B2 * 8/2002 Ohata ..... C21D 8/1205 148/111
9,333,546 B2 5/2016 Abe
2002/0017747 A1 * 2/2002 Sugano ..... C21D 9/563 266/259
2010/0101690 A1 * 4/2010 Koga ..... C21D 8/12 148/567
2014/0110890 A1 * 4/2014 Noe ..... C21D 9/54 266/44

OTHER PUBLICATIONS

Corresponding International Search Report for PCT/IB2015/058308 dated Jan. 29, 2016. WO.
Mazur V L et al: "Influence of Tension-Flex Levelling of Steel Sheet on its Mechanical Properties and Formability", Steel in Translation, Allerton Press, New York, NY, US, vol. 22, No. 9, Sep. 1, 1992, pp. 414-415, XP000369712.
Magura, Daniel et al., "Distribution of the Strip Tensions with Slip Control in Strip Processing Lines," Energies, 2019, 12, 3010; http://dx.doi.org/10.3390/en12153010, pp. 1-15.

* cited by examiner

METHOD FOR ORIENTING STEEL SHEET GRAINS, CORRESPONDING DEVICE, AND FACILITY IMPLEMENTING SAID METHOD OR DEVICE

PRIORITY

Priority is claimed as a national stage application, under 35 U.S.C. § 371, to international patent application No. PCT/IB2015/058308, filed Oct. 28, 2015, which claims priority to French patent application 1460385, filed Oct. 29, 2014. The disclosures of the aforementioned priority applications are incorporated herein by reference in their entirety.

TECHNICAL FIELD

The invention relates to the field of the manufacture of steel for electrotechnical applications, for example, although nonlimitingly, used to produce magnetic circuits for transformers.

The invention relates more particularly to a method that makes it possible to accentuate the orientation of the grains in a steel sheet in a magnetic sheet manufacturing process, and to a device allowing the implementation of such a method.

The present invention also relates to a facility for producing magnetic sheet implementing this method and this device.

PRIOR ART

The efficiency of an electrical machine, for example a transformer, is notably reduced by magnetic losses that occur in the magnetic circuits of such a machine. Optimizing the efficiency therefore entails manufacturing magnetic circuits which as far as possible limit the losses that these circuits are liable to cause.

To this end, it is known practice to produce magnetic yokes or field frames as stacks of sheet laminations. The stack of sheet laminations makes it possible to reduce the losses associated with the presence of eddy currents as compared with solid components made as a single piece.

To this same end, the sheet laminations are typically made of a steel containing silicon and of which the grains, which means to say elements of its metallurgical structure, are oriented (steel of the GO type). Such steel sheet is referred to as "magnetic steel" or alternatively "electrical steel".

In general, magnetic sheet intended for electrotechnical applications is typically produced in such a way as to conduct a magnetic flux in a main direction, generally the direction of rolling, referred to as the Goss direction.

FIGS. 1 and 2 each depict a specimen 1*x*, 1*y* of steel sheet, the grains of which are depicted in the schematic form of rectangular prisms 2*a*, 2*b*, 2*c*, 2*d*, 2*e*, 2*f*. The specimen 1*x* of FIG. 1 comprises grains 2*a*, 2*b*, 2*c* which are oriented relative to one another randomly, which means to say that their respective faces occupy random orientations in space with respect to a direction 3. In this case, the specimen 1*x* is a sheet, the grains of which are said to be non-oriented (steel NGO type).

In the specimen 1*y* of FIG. 2, the grains 2*d*, 2*e*, 2*f* are arranged in a substantially identical orientation close to the direction 3 which is, for example, a direction of rolling, namely a direction in which the sheet has undergone a stretching operation.

FIG. 3 depicts the crystal structure of a specimen 1*z* of grain oriented (GO) steel sheet, showing the grains in a plane parallel to a main face of the sheet. It shows grains 2*g*, 2*h* which are large in size and the main orientations of which are substantially parallel to the direction 3, for example the direction of rolling.

Typically, electrical steels contain 3.5% silicon, whereas a traditional carbon steel contains between around 0.3 and 0.6% thereof.

The manufacture of electrical silicon steels is typically aimed at obtaining the highest possible size for the primary grains, for example 5-15 μm in the case of GO type steels, and 20-200 μm in the case of NGO type steels, or in the case of steels in which the grains are semi-oriented. It also aims to obtain a high size for the secondary grains, typically 1-5 mm for steels of CRGO (cold rolled grain oriented) type, or even 5-30 mm for of high quality electrical steels such as steels of HiB type.

Typically the mean orientation of the grains in GO steels needs to be achieved with an alignment tolerance of ±2° with respect to the Goss direction for the secondary grains and an alignment tolerance of ±1.5° for the primary grains for a primary grain angle ranging up to 10° with respect to the Goss direction.

At least two main methods for the manufacture of grain oriented magnetic steels are known from the prior art: a "hot" method and a "cold" method.

The "hot" method consists in dissolving into a sheet inhibitors that inhibit grain growth in the non-desired orientations, by heating it up to a temperature of 1300-1400° C. The formation of fine grains is then achieved in a hot-rolling mill, after which a cold-rolling followed by a decarburizing annealing operation are typically performed in order to obtain the primary grains with deposition of magnesium oxide (mainly) on the surface of the sheet. Grain growth in a preferential direction is obtained beforehand during an additional annealing to around 1200° C. in furnaces of the bell furnace type.

The "cold" method consists in partially dissolving into the sheet inhibitors that inhibit grain growth in the undesired orientations by heating it to a temperature of around 1200° C. The precipitation of the fine grains and the orientation of the grains are performed in hot-rolling and cold-rolling mills and are followed by an annealing, a nitriding and a deposition of MgO (mainly). Grain growth in a preferential direction is performed in an annealing operation from 1000-1200° C. in furnaces of the bell furnace type in order to obtain the secondary grains.

The size of the grains is not all; it is important that they be oriented in the Goss direction. Such an orientation may lead to an increase in the magnetic flux density that can be as much as 30% by comparison with a steel in which the grains are non-oriented. In general, the Goss direction is parallel to the plane of the sheet and may correspond to the direction of rolling.

It may be seen that the manufacture of grain orientated magnetic sheet according to the methods described hereinabove entails a succession of thermal and mechanical operations.

The manufacturing steps in such methods involve intermediate operations of storing and handling the sheet to transfer it from one workstation to another, the thermal and mechanical operations generally being performed separately. Each corresponding treatment and handling operation takes time and involves setting in place a production organization that is sufficiently precise that equipment availability at the required time is assured.

Another disadvantage of the methods described hereinabove is that they give rise to an imprecise grain orientation which may vary by around ±10° with respect to the direction of rolling.

U.S. Pat. No. 3,130,088 describes a solution for the thermal flattening of metal strips. Leveling rolls of limited diameter, through which the strip passes alternately, are placed in the furnace. These small-diameter leveling rolls create transverse homogeneity in the stress in the strip by producing elongation by bending at the surface of the sheet and, as a secondary issue, elongation of this sheet by pure traction, this being limited by the deformation already generated at the surface. The total elongation obtained is limited, up to a maximum of 3%. This method generates heterogeneity in the elongation in the thickness of the sheet and heterogeneity in the grain orientation.

In addition, U.S. Pat. No. 3,130,088 describes a tensioning of the strip at the inlet and outlet of the furnace using pinch rolls. The traction that can be transmitted to the strip by this device is limited because of the very small area of contact between the strip and the pinch rolls. As a result, a very high pinch roll pressure force is needed in order to obtain a high level of traction, and this has the effect of crushing the strip and therefore generating an undesired variation in thickness.

SUMMARY OF THE INVENTION

It is an object of the present invention to propose a device and a method making it possible to alleviate all or some of the disadvantages mentioned hereinabove, particularly making it possible to accentuate the orientation of the grains in a grain oriented steel sheet and to lengthen these grains in said orientation while at the same time reducing the total number of operations required in order to obtain this grain orientation.

It is an object of the present invention to propose a device that makes it possible to alleviate all or some of the disadvantages mentioned hereinabove and that in particular makes it possible to improve the precision with which the grains of a silicon steel sheet are oriented while at the same time reducing the total number of operations needed to obtain this grain orientation.

It is another object of the present invention to propose a device and a method making it possible to reduce the annealing temperature levels and/or the number and the quantity of inhibitors used in the methods known from the prior art.

To this end, the invention proposes a method for modifying or accentuating the orientation of the grains of a steel sheet, preferably a grain oriented steel sheet, and to elongate these grains in said orientation during an operation of annealing the steel sheet in a continuous heat treatment furnace, this operation being used in particular for the manufacture of magnetic steel sheet, this method comprising:

- a step of moving the steel sheet in its longitudinal direction, during which the steel sheet is moved in the furnace,
- a step of soaking of maintaining a stretch region of the steel sheet at a set temperature of between 750° C. and 900° C.,
- a step of stretching the steel sheet longitudinally in the stretch region.

For preference, the method according to the invention comprises no surface bending elongation of the steel sheet.

Performing stretching on a steel sheet at such a temperature allows elongation of the grains and an increase in the precision with which the grains are oriented with respect to the direction of travel of the sheet, which is also the direction of rolling or Goss direction, by comparison with a rolling method according to the prior art.

An example of the result obtained with such stretching is given in FIG. 9 which depicts two grains g1, g2 of respective lengths Lg1, Lg2 oriented at respective angles θ1, θ2 with respect to the direction of rolling 3. The grain g2 is obtained from the grain g1 by implementation of the method according to the invention. It may be seen that, after elongation according to the invention, the grain has a length Lg2 and an angle θ2 which are such that Lg2> Lg1 and θ2<θ1.

The applicant company has calculated that such stretching according to the invention makes it possible to reduce the mean angle θ formed by the grains with respect to the direction of rolling according to the examples given in the following table. This table indicates a grain angle θ calculated as a function of the stretching of the steel sheet in the direction of rolling and of the initial inclination of the grain.

| Stretching of the sheet in the direction | Grain angle θ obtained by elongation of the sheet for an initial grain inclination of: | | | |
|---|---|---|---|---|
| of rolling | 1° | 2° | 4° | 10° |
| 3% | 0.94° | 1.88° | 3.77° | 9.43° |
| 6% | 0.91° | 1.77° | 3.55° | 8.89° |
| 10% | 0.82° | 1.64° | 3.28° | 8.21° |

The table above shows that the step of stretching the sheet according to the method of the invention allows the original angle of orientation of the grains (namely the angle before the stretching of the sheet at said temperature according to the method of the invention) to be straightened up in the Goss direction by around 0.05° to 1.8°.

Likewise, the following table indicates a percentage elongation of the grain length L by implementation of the invention, calculated as a function of the stretching of the steel sheet and of the initial grain inclination.

| Stretching of the sheet in the direction | Percentage elongation of grain length L obtained by elongation of the sheet according to the invention for an initial grain inclination of: | | | |
|---|---|---|---|---|
| of rolling | 1° | 2° | 4° | 10° |
| 3% | 2.99% | 2.93% | 2.75% | 1.43% |
| 6% | 5.99% | 5.93% | 5.74% | 4.39% |
| 10% | 9.96% | 9.93% | 9.73% | 8.32% |

The table above shows that the step of stretching the sheet according to the method of the invention allows the original grain length, namely the length before stretching of the sheet at said temperature according to the method of the invention, to be elongated overall in the Goss direction by around 3 to 10%.

The increase in the precision with which the grains are oriented, relative to a mean direction, results in an improvement of the magnetic properties of the steel, particularly its magnetic permeability. It is considered that the reduction in iron losses may be as much as 38% for medium grain angles (between 5° and) 10°, whereas it is only 7% for smaller angles (between 0.5° and 4°).

The method according to the invention therefore makes it possible to grow the grains in the direction of rolling of the sheet and throughout the thickness thereof, while at the same time improving the angle formed by the grains with respect to this direction of rolling, thereby improving the magnetic permeability of the electrical steel throughout its thickness by reducing iron losses.

Furthermore, it may be seen that the method according to the invention advantageously combines mechanical and thermal operations, making it possible to limit the disadvantages associated with performing successive mechanical and thermal operations which, in the methods known from the prior art, are performed separately.

The stretching of a steel sheet in a furnace, particularly at the end of the heating zone or in the temperature zone of soaking, is particularly advantageous because the temperature of the steel there is stable, and so the metallurgical structure there is likewise homogeneous and stable. These conditions allow the stretching to be applied in a perfectly controlled way in order to obtain the desired result. This stretching of the sheet may also be performed, for example and nonlimitingly, in a decarburizing zone or a nitriding zone in which the temperature conditions and metallurgical structure of the sheet are also practically constant.

Advantageously according to the invention, in order to stretch the steel sheet it is brought into driving engagement with two motorized tensioning blocks situated in the furnace. The tensioning blocks, referred to as "S-blocks", are situated one on each side of the stretch region and define two different speeds of travel for the steel sheet, respectively upstream and downstream of the stretch region. Depending on the strength of the traction to be applied to the sheet, these S-blocks may comprise two rolls or more.

The stretching of the steel sheet by motorized tensioning blocks arranged in this way allows a localized treatment of the stretch region, particularly a controlled grain elongation.

As indicated above, these tensioning blocks are advantageously installed at the end of the heating zone, in the temperature zone of soaking or possibly in the decarburizing zone or in the nitriding zone, so as to apply controlled traction to the sheet in a zone in which the temperature and the structure of the steel are stable. This ensures perfect control over the application of traction to the strip in order to achieve the desired grain elongation and orientation objectives.

For preference, the steel sheet has a thickness less than or equal to around 0.5 mm, preferably around 0.3 mm.

Advantageously, the degree of elongation applied according to the invention to the steel sheet during the stretching step is well above the usual values obtained by leveling. Specifically, the degree of elongation obtained by leveling is limited to 3%, given their design by a combination of wrapping around rolls of limited diameter and pure traction. The degree of elongation applied to the steel sheet during the stretching step according to the invention may be less than or equal to 10%.

This degree of elongation may be achieved by placing the strip in traction in the furnace between two tensioning blocks fitted with large-diameter rolls.

According to one embodiment of the invention, a silicon steel strip 0.35 mm thick and 1050 mm wide and at a temperature of 750° C. is tensioned in the stretching zone. As the table below shows, a tension of 53 MPa in the strip makes it possible, with this grade of steel, to achieve a 10% elongation thereof.

| Tension MPa | 34.2 | 47.8 | 50.5 | 53.0 | 55.0 | 57.0 | 58.0 |
|---|---|---|---|---|---|---|---|
| Elongation % | 0.08% | 3.2% | 5.6% | 10.0% | 17.2% | 36.5% | 59.8% |

As shown in the table below, for the same grade of silicon steel raised to 900° C., a tension of 20 MPa is sufficient to obtain an elongation of 10%.

| Tension MPa | 19.0 | 20.1 | 21.1 | 22.1 | 23.1 |
|---|---|---|---|---|---|
| Elongation % | 3.8% | 10.1% | 21.1% | 44.2% | 77.0% |

The device according to the invention allows the same level of tension to be applied across the entire width and throughout the entire thickness of the strip, leading to an elongation that is perfectly distributed, avoiding any risk of rupture of the strip. For this grade of steel this is performed for a tension of 58 MPa at 750° C. and 23.1 MPa at 900° C.

Advantageously, the number and diameter of the rolls in the tensioning blocks is determined in such a way as to limit the plastic deformation of the strip in the tensioning blocks. In our embodiment above, tensioning blocks comprising four rolls and with a roll diameter of 800 mm are well suited. Indeed it may be seen from the table below, for a strip at 750° C., that the level of traction in the strip is limited to 34.2 MPa between the $3^{rd}$ and $4^{th}$ roll of the inlet tensioning block, giving an elongation that is limited to 0.08% between these rolls and negligible before them.

| | Outlet from the $1^{st}$ roll | Outlet from the $2^{nd}$ roll | Outlet from the $3^{rd}$ roll | Outlet from the $4^{th}$ roll |
|---|---|---|---|---|
| Tension MPa | 12.1 | 20.6 | 34.2 | 53.0 |

The roll diameter is validated by so-called "coil-break" calculations which define the minimum roll diameter needed to avoid plastic and permanent deformation which would limit the amount of traction in the strip and therefore the amount of elongation homogeneous in the thickness thereof. Roll diameter values of 400 mm minimum make it possible to keep away from the negative deformation criteria, which are dependent on strip strength and temperature. Increasing the diameter of the rolls naturally leads to more attractive results, the economic criterion being the only limitation. Likewise, the number of rolls is a secondary criterion that allows a more progressive increase in the elongation as the number of rolls increases. Once again, the only limitation is the economic criterion.

The results above are of course dependent on the nature of the steel, notably on the elastic modulus values as a function of temperature and on the amount of traction applied, which causes this elastic modulus to vary.

The use of pinch rolls, as described in U.S. Pat. No. 3,130,088, would not be suitable in the method according to the invention because a very high force would need to be applied to the strip in order to obtain an increase in traction similar to the new device according to the invention, and this would have the effect of generating significant crushing of the strip, because of its temperature level, and therefore an undesired variation in thickness. Whereas pinch rolls give a very limited angle of wrap around the rolls (a few degrees), the device according to the invention allows very high degrees of wrap, for example from 300° to around 800° approximately.

The device according to the invention applies pure traction to the sheet which gives a homogeneity of the grain orientation in its thickness by minimizing the surface elongation through the use of large-diameter rolls defined for that purpose. It makes it possible to obtain greater pure traction while exhibiting far lower surface deformation which is therefore further away from the coil break limit. In the new device according to the invention, the variation in cross section resulting from the elongation of the strip is achieved through a variation in its width rather than through a variation in its thickness, which remains constant; the forces on the strip remain tangential to the strip and not perpendicular thereto, thereby not giving rise to crushing. This situation of hot variation in width is furthermore known in the art of sheet annealing furnaces.

The continuous treatment of the sheet according to the invention considerably simplifies the production of grain oriented steels by comparison with the methods known from the prior art by simultaneously, in a single furnace and during a single pass of the sheet through this furnace, per forming the operation of metallurgical annealing of the steel and the step of hot grain elongation. At the present time, according to the prior art, this operation and this step are performed in succession with different pieces of equipment, entailing making these different pieces of equipment available and passing the sheet successively through these pieces of equipment. These successive operations and steps involve intermediate handlings of the coils of sheet, the availability of various different pieces of equipment with their operating crews, corresponding energy consumption and corresponding potential emissions of pollutants. The present invention makes it possible to eliminate these disadvantages.

According to one advantageous feature, after the stretching step, the steel sheet passes continuously to a nitriding step.

In order to implement the method according to the invention, the invention also proposes a device comprising traction apparatus, this traction apparatus comprising at least one upstream tensioning block (or S-block) and one downstream tensioning block (or S-block), the upstream tensioning block comprising a first group of traction rolls, the downstream tensioning block comprising a second group of traction rolls, the traction rolls of the upstream tensioning block and of the downstream tensioning block being arranged in such a way as to apply traction to the stretch region of the steel sheet, the furnace comprising heating means able to heat the stretch region of the steel sheet to the set temperature and hold it at that temperature.

According one advantageous feature, the application of traction to the sheet necessary to obtain high precision grain orientation may be achieved by a controlled turning of at least one traction roll in each tensioning block. In order to do this, one advantageous solution is to subject the at least one roll of each tensioning block to a specific speed or a specific torque so that the speed of travel of the steel sheet is greater in the downstream tensioning block than in the upstream tensioning block.

Advantageously, the traction rolls of the two tensioning blocks are driven at speeds that increase progressively from upstream to downstream along the path along which the steel sheet moves.

Advantageously, the traction apparatus is designed to allow the steel sheet to be moved in a linear path in which the steel sheet is brought into contact with at most part of the traction rolls without being placed in traction by the traction apparatus. The traction apparatus thus installed in a furnace allows the heat treatment line to be used in the conventional way because the traction apparatus can be bypassed by the sheet which then follows a conventional treatment cycle according to the prior art.

The invention also relates to a facility for the production of magnetic sheet, comprising a line comprising a rolling mill and on which the method and/or a device according to various combinations of the features that have just been described is implemented downstream of the rolling mill.

According to one advantageous feature, the line further comprises a leveler comprising leveling rolls.

According to one advantageous feature, the line further comprises a decarburizing device upstream of said method and/or device.

According to another advantageous feature, the line additionally comprises a nitriding device downstream of said method and/or device.

Several further advantages follow from the features that have just been explained.

The invention also makes it possible to reduce the number of operations involved in the hot or cold production of grain oriented electrical steel, to increase the overall gain in productivity of the facility, to reduce the energy consumption, or even to reduce the handling of the coils, labor and pollutant emissions. The overall cost of producing the steel is thus reduced considerably.

As we have seen, the invention is clearly demarcated from the leveling system by producing pure traction in the sheet which gives rise to homogeneity in the orientation of the grains in its thickness while minimizing the surface elongation through the use of large-diameter rolls defined for that purpose. The method makes it possible to obtain greater pure traction because there is far less surface deformation which means it is therefore further away from the coil break limit.

In addition, as we have seen, the invention differs from the usual methods notably through:

- the possibility of orienting the grains and elongating them in the direction referred to as the Goss direction, beyond the values usually achieved,
- the possibility of orienting them homogeneously in the thickness of the strip,
- the possibility of performing these two actions without a variation in strip thickness,
- it allows the magnetic permeability values for the sheets to be increased substantially, by around 7 to 38%.

DESCRIPTION OF THE FIGURES AND EMBODIMENTS

Further advantages and specifics of the invention will become apparent from reading the detailed description of non-limiting embodiments and implementations, and from studying the following attached figures.

Figure 1:
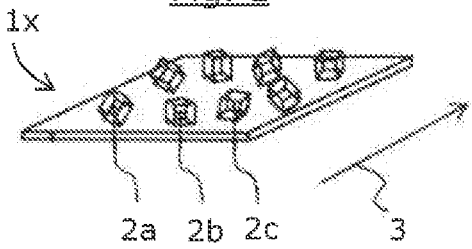
FIG. 1 depicts a specimen of non-grain-oriented steel sheet.
Figure 2:
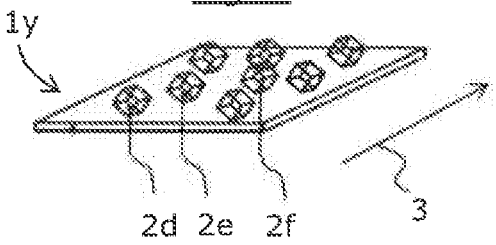
FIG. 2 depicts a specimen of grain oriented steel sheet.
Figure 3:
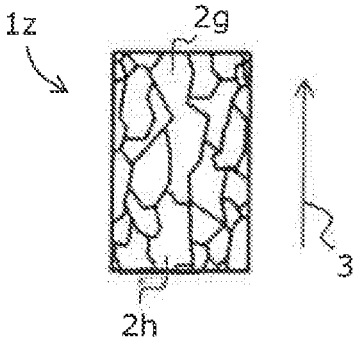
Figure 4:
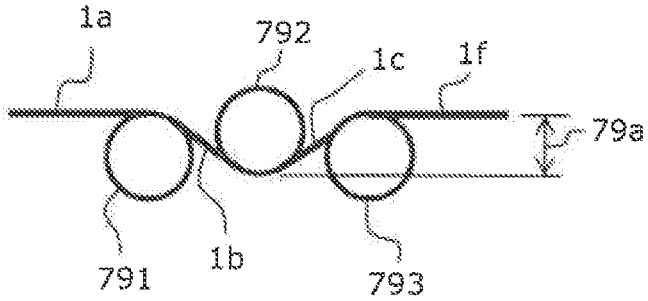
Figure 5:
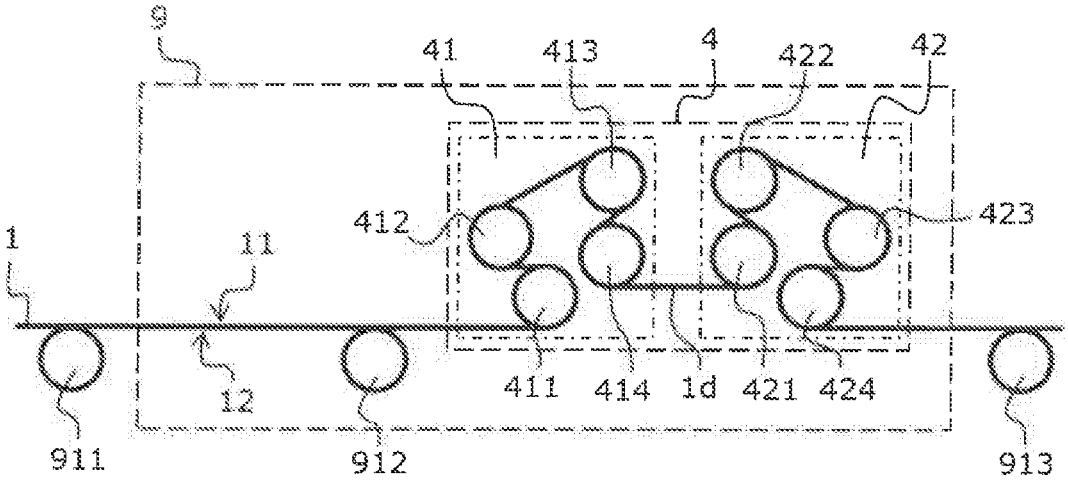
Figure 6:
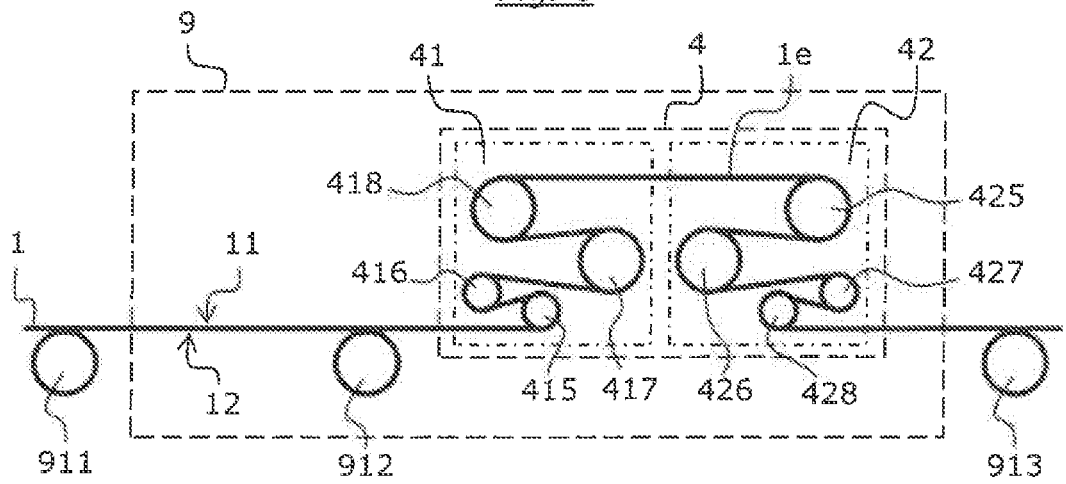
Figure 7:
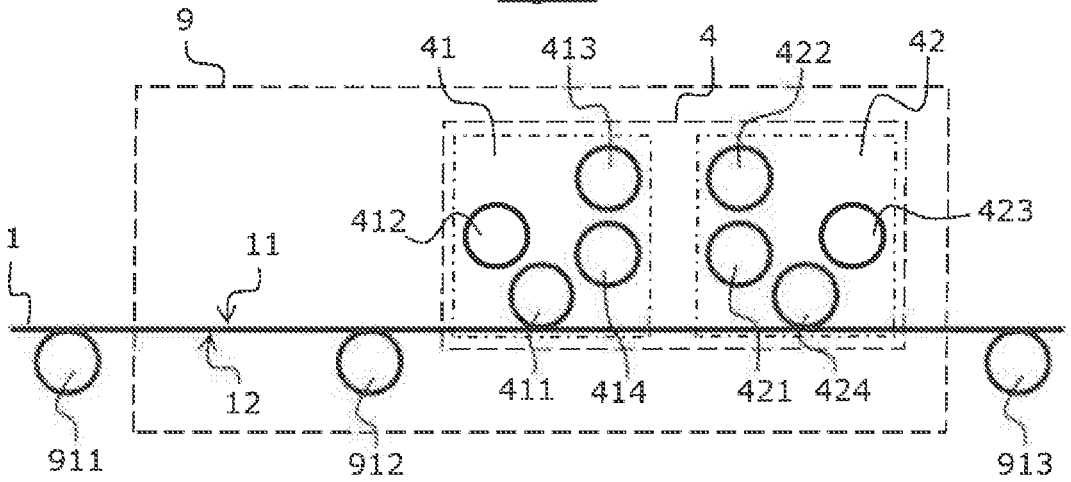
Figure 8:
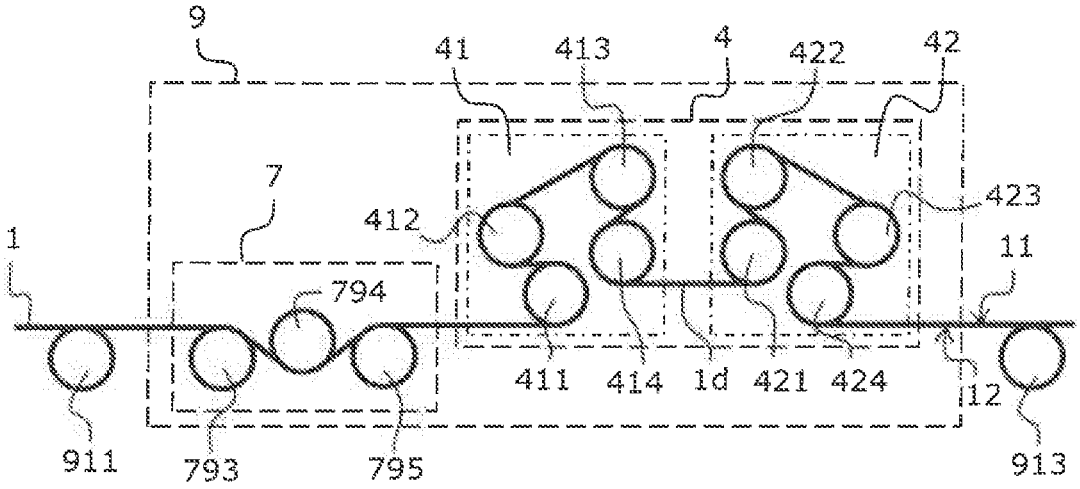
Figure 9:
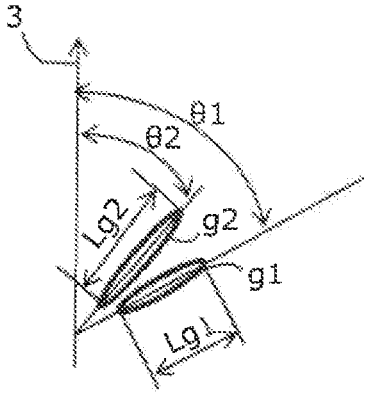

FIG. 3 illustrates the crystal structure of a specimen of steel sheet on a plane parallel to a main face of the sheet, FIG. 4 depicts a steel sheet deformed by three leveling rolls, FIG. 5 depicts a steel sheet passing over transport rolls and traction rolls of a traction system according to a first embodiment, FIG. 6 depicts a steel sheet passing over transport rolls and traction rolls of the traction system according to a second embodiment, FIG. 7 depicts the device of FIG. 5 in which the steel sheet is not inserted through the traction system, FIG. 8 depicts the device of FIG. 5 comprising a leveler installed upstream of the traction system, FIG. 9 depicts two grains respectively before and after implementation of the method according to the invention.

Because the embodiments described in this text are entirely nonlimiting, alternative forms of the invention comprising only a selection of the features described, in isolation from the other features described may notably be considered (even if this selection is isolated from within a sentence containing these other features) if this selection of features is enough to confer a technical advantage or to differentiate the invention from the prior art. This selection comprises at least one feature which is preferably functional without structural details or with just some of the structural details if this part alone is sufficient to confer a technical advantage or to differentiate the invention from the prior art.

With reference to FIGS. 5 to 8, the traction apparatus 4 according to the invention preferably comprises two tensioning blocks 41, 42.

Each tensioning block, or S-block, comprises at least one traction roll, for example as in FIGS. 5 to 8, where there are four.

These traction rolls may have mutually identical diameters (FIGS. 5, 7 to 9), or different diameters from one another (FIG. 6).

In the example depicted in FIG. 7, a steel sheet 1 is passing through a furnace 9, for example an annealing furnace on support rolls 911, 912, 913, from an inlet (to the left in the figure) to an outlet (to the right in the figure) of this furnace 9. In this example, the steel sheet 1 is not inserted through the traction rolls of the traction apparatus 4 and this traction apparatus 4 therefore does not perform its function of stretching the steel sheet 1. This configuration, for example, makes it possible to perform a heat treatment on the steel sheet 1 in the furnace 9 without applying any stretching force to the steel sheet 1. Alternatively, the traction apparatus 4 may be installed in the furnace 9 so that no traction roll at all is brought into contact with the steel sheet 1 when the sheet is being moved according to what has just been described.

With reference to FIG. 5, the steel sheet 1 also rests on the support rolls 911, 912, 913. In the traction zone 4, the sheet is wrapped around the rolls of the S-blocks in such a way that sufficient adhesion can be obtained between these rolls and the sheet to obtain the desired level of traction in a region 1*d* of stretching of the sheet 1. The stretching force on the sheet in the stretching region 1*d* may be obtained and controlled by a differential between the speeds or torques of various traction rolls.

The same comments apply to the example depicted in FIG. 6, in which the actuated rolls are, for example, the traction rolls 418, 425. It may be seen that the arrangement of the traction rolls in FIG. 6 results in the region of stretching 1*e* of the steel sheet 1 having a dimension which is greater (in the direction of travel of the sheet, namely from left to right in the figure) than that of the region of stretching 1*d* of FIG. 5.

The layout of the traction rolls in the tensioning blocks 41, 42 or even the relative positioning of the tensioning blocks 41, 42 in the traction apparatus allows control over the dimension of the region of stretching 1*d*, 1*e* of the steel sheet 1 in the direction of travel of this sheet, making it possible to optimize the stretching force applied as a function, for example, of the mechanical properties of the steel sheet 1 or of the thermal conditions of the furnace 9. It is known, for example, that a larger region of stretching 1*e* allows the sheet to be kept under tension in this region of stretching for longer in order to obtain given mechanical properties at the end of this treatment.

The optimization of this stretching force, or the conditions of friction of the steel sheet 1 against the traction rolls, can also be controlled through the diameter of the traction rolls (for example multiple diameters of roll in the example of FIG. 6) and through the choice of material from which these rolls are made or of the surface finish of the table of the rolls.

More generally, the layout of the traction rolls may thus be chosen according to the type of treatment to be performed or the type of material to be treated.

FIG. 8 depicts the device of FIG. 5 with a leveler 7 installed upstream of the traction apparatus 4. This leveler 7 comprises leveling rolls 793, 794, 795 brought alternately into contact with the upper 11 and lower 12 surfaces of the steel sheet 1.

FIG. 4 depicts three leveling rolls 791, 792, 793 and a steel sheet comprising four parts 1*a*, 1*b*, 1*c*, 1*f* situated respectively upstream of the leveling roll 791, between the two leveling rolls 791, 792, between the two leveling rolls 792, 793, and downstream of the leveling roll 793. The distance 79*a* separating the leveling rolls 791, 792, 793 is preferentially substantially equal to 70% of the diameter of these leveling rolls 791, 792, 793. When several leveling rolls are installed in the leveler 7, this separation 79*a* may vary so as to avoid, for example, any residual curl in the steel sheet 1 leaving the leveler 7.

According to FIG. 8, the leveler 7 is arranged in such a way as to reduce defects in the shape of the sheet entering the traction system 4 so as to allow the sheet to be tensioned uniformly across its width.

Alternatively, the leveler may be mounted downstream of the traction apparatus 4 so as to obtain, for example, flatness characteristics suited to treatment steps performed on the steel sheet 1 after the stretching method according to the invention.

Of course, the invention is not limited to the examples that have just been described and numerous variations may be made to these examples without departing from the scope of the invention. In addition, the various features, forms, alternatives and embodiments of the invention may be combined with one another in various combinations insofar as they are not mutually incompatible or mutually exclusive.

The invention claimed is:

1. A method of accentuating an orientation of grains of a sheet of grain oriented steel during an operation of annealing the steel sheet in a continuous heat treatment furnace, the method comprising:

moving the steel sheet in its longitudinal direction through the furnace;

soaking the steel sheet to maintain a stretch region of the steel sheet at a set temperature of between 750° C. and 900° C.;

stretching the steel sheet longitudinally in the stretch region by bringing the steel sheet into driving engagement with a first motorized tensioning block and a second motorized tensioning block situated in the furnace, the first motorized tensioning block comprising a first plurality of traction rolls which engage the steel sheet and the second motorized tensioning block comprising a second plurality of traction rolls which engage the steel sheet, the first and second motorized tensioning blocks being situated one on each side of the stretch region; and wherein the driving engagement with the first motorized tension block and with the second motorized tension block creates a tension on the steel sheet in the stretch region, the tension being evenly applied across an entire width and throughout an entire thickness of the steel sheet.

2. The method as claimed in claim 1, further comprising nitriding the steel sheet after the steel sheet is stretched.

3. The method as claimed in claim 1, wherein the degree of elongation applied to the steel sheet during the stretching of the steel sheet is from 3.2% to 10%.

4. The method as claimed in claim 1, further comprising a leveler adjacent to the first motorized tensioning block or the second motorized tensioning block.

5. The method as claimed in claim 1, wherein the furnace is an annealing furnace.

6. The method as claimed in claim 1, wherein the first motorized tensioning block drives the steel sheet at a first speed of travel and the second motorized tensioning block drives the steel sheet at a second speed of travel, the second speed of travel being greater than the first speed of travel.

7. The method as claimed in claim 1, wherein the steel sheet comprises a first surface opposite a second surface, and wherein the most downstream one of the first plurality of traction rolls and the most upstream one of the second plurality of traction rolls are engaged with the first surface of the steel sheet.

8. The method as claimed in claim 1, wherein the steel sheet winds at least 180 degrees around at least one of the traction rolls of the first plurality of traction rolls and at least 180 degrees around at least one of the traction rolls of the second plurality of traction rolls.

9. A method of accentuating an orientation of grains of a steel sheet, the method comprising:

moving the steel sheet through a furnace in a longitudinal direction of the steel sheet, the steel sheet comprising a grain oriented magnetic steel sheet; and stretching the steel sheet longitudinally in a stretch region by bringing the steel sheet into driving engagement with a first motorized tensioning block and a second motorized tensioning block, the stretch region being between the first motorized tensioning block and the second motorized tensioning block, each of the first and second motorized tensioning blocks being situated in the furnace and each comprising a plurality of traction rolls, each traction roll engaging the steel sheet;

wherein the first motorized tensioning block and the second motorized tensioning block effectuate a stretch in the steel sheet from 3.2% to 10%.

10. The method as claimed in claim 9, further comprising nitriding the steel sheet after the steel sheet is stretched.

11. The method as claimed in claim 9, wherein the first and second motorized tensioning blocks are situated on opposite sides of the stretch region and define two different speeds of travel for the steel sheet, respectively upstream and downstream of the stretch region.

12. The method as claimed in claim 9, wherein the steel sheet comprises a first surface opposite a second surface, and wherein a most downstream traction roll of the first motorized tensioning block and a most upstream traction roll of the second motorized tensioning block engage with the first surface of the steel sheet.

13. The method as claimed in claim 9, wherein the steel sheet winds at least 180 degrees around at least one of the plurality of traction rolls of the first motorized tensioning block and at least 180 degrees around at least one of the plurality of traction rolls of the second motorized tensioning block.

14. The method as claimed in claim 9, wherein at least one of the traction rolls of the first motorized tension block is in driving engagement with the steel sheet and at least one of the traction rolls of the second motorized tension block is in driving engagement with the steel sheet.

15. A method of accentuating an orientation of grains of a steel sheet, the method comprising:

moving the steel sheet through a furnace in a longitudinal direction of the steel sheet, the steel sheet comprising a grain oriented magnetic steel sheet; and stretching the steel sheet longitudinally in a stretch region by bringing the steel sheet into driving engagement with a first motorized tensioning block and a second motorized tensioning block, the stretch region being between the first motorized tensioning block and the second motorized tensioning block, each of the first and second motorized tensioning blocks being situated in the furnace and each comprising a plurality of traction rolls, each traction roll engaging the steel sheet;

wherein the first and second motorized tensioning blocks are controlled to apply to the steel sheet a tension in the stretch region from 34 MPa to 58 MPa at 750° C.

16. The method as claimed in claim 15, further comprising nitriding the steel sheet after the steel sheet is stretched.

17. The method as claimed in claim 15, wherein the first and second motorized tensioning blocks are situated on opposite sides of the stretch region and define two different speeds of travel for the steel sheet, respectively upstream and downstream of the stretch region.

18. The method as claimed in claim 15, wherein the steel sheet comprises a first surface opposite a second surface, and wherein a most downstream traction roll of the first motorized tensioning block and a most upstream traction roll of the second motorized tensioning block engage with the first surface of the steel sheet.

19. The method as claimed in claim 15, wherein the steel sheet winds at least 180 degrees around at least one of the plurality of traction rolls of the first motorized tensioning block and at least 180 degrees around at least one of the plurality of traction rolls of the second motorized tensioning block.

20. The method as claimed in claim 15, wherein at least one of the traction rolls of the first motorized tension block is in driving engagement with the steel sheet and at least one of the traction rolls of the second motorized tension block is in driving engagement with the steel sheet.

21. The method as claimed in claim 1, wherein the first and second motorized tensioning blocks are controlled to apply to the steel sheet a tension in the stretch region from 34 MPa to 58 MPa.

* * * * *